US005431402A

United States Patent [19]

Aguilera

[11] Patent Number: 5,431,402

[45] Date of Patent: Jul. 11, 1995

[54] GOLF COURSE

[76] Inventor: Miguel Aguilera, 13728 SW. 13 St., Miami, Fla. 33184

[21] Appl. No.: 174,084

[22] Filed: Dec. 28, 1993

[51] Int. Cl.[6] ..... A63B 69/36

[52] U.S. Cl. ..... 273/176 AB; 273/176 R

[58] Field of Search ..... 273/176, 32 R, 181 R, 273/181 F, 35 R, 35 B

[56] References Cited

U.S. PATENT DOCUMENTS

| | | | |
|---|---|---|---|
| 1,851,423 | 3/1932 | Ely . | |
| 3,685,832 | 8/1972 | Johnson . | |
| 3,695,619 | 10/1972 | Brobston | 273/176 A |
| 3,990,708 | 11/1976 | Ingwersen | 273/176 A |
| 4,145,053 | 3/1979 | Healey . | |
| 4,798,385 | 1/1989 | Tegart | 273/176 A |
| 5,163,683 | 11/1992 | Oswald | 273/176 R |
| 5,265,875 | 11/1993 | Fitzgerald | 273/176 A |

FOREIGN PATENT DOCUMENTS

| | | | |
|---|---|---|---|
| 2018208 | 10/1992 | WIPO | 273/176 R |

*Primary Examiner*—Mark S. Graham

[57] ABSTRACT

A golf course for playing golf in a reduced space while maintaining the continuity of the game and minimizing the time that other players have to wait. The golf course includes elongated first (20), second (40) and third (60) shot areas adjacent to each other. The areas are provided with the teeing area of the first shot area in close proximity to the fairway and approach/putting shot areas thereby minimizing the walking required from the player. The landing grid areas and the fairway and approach/putting areas are quadriculated in order to permit the ready identification of where a ball landed and to transpose to the landing position for the next shot. A slight grading of the landing grid area of the first and second shot areas permits the determination of the ball's position with the unaided eye. The teeing area is raised with respect to the adjacent fairway area of the first shot area.

5 Claims, 4 Drawing Sheets

GOLF COURSE

II. BACKGROUND OF THE INVENTION

1. Field of the Invention

The present invention relates to golf courses, and more particularly, to compact golf courses that efficiently utilize a predetermined area.

2. Description of the Related Art

A number of compact golf courses have been designed in the past. One of these golf courses is described in Healey's patent issued on Mar. 20, 1979 under U.S. Pat. No. 4,145,053. However, it differs from the present invention in that it is a different design or layout requiring two "third" holes and the balls are hit from five predetermined positions.

Other golf courses are described in U.S. Pat. Nos. 1,851,423 and 3,685,832 issued to Ely and Johnson, respectively. While these golf courses tend to minimize the walking which is necessary in playing golf, they fail to disclose a golf course that can effectively reproduce an 18-hole golf course in minimum space.

III. SUMMARY OF THE INVENTION

It is one of the primary objectives of the present invention to provide a golf course that efficiently utilizes space while avoiding making any significant compromises that would materially distinguish it from conventional golf courses.

It is yet another object of this invention to provide a golf course that minimizes the walking which is necessary to play the game thereby ensuring the continuity of the golf shots and minimizing delays.

It is still another object of this invention to provide a golf course wherein the players will not be crossing balls.

It is yet another object of this invention to provide a golf course with strategic topographical grading at the end of the fairway with a grid defined in the most probable landing area so that a player can visually, and without visual aids, transpose the ball's position for the second shot to an adjacent clone field that simulates where the player would have been after walking down the entire fairway of a particular hole in order to take his next shot.

It is still another object of this invention to provide a golf course wherein the fields for the second and third shots for a given hole may be shared.

It is another object of this invention to provide a golf course that requires a minimum of maintenance.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

V. DETAILED DESCRIPTION OF THE PREFERRED EMBODIMENT

Figure 1:
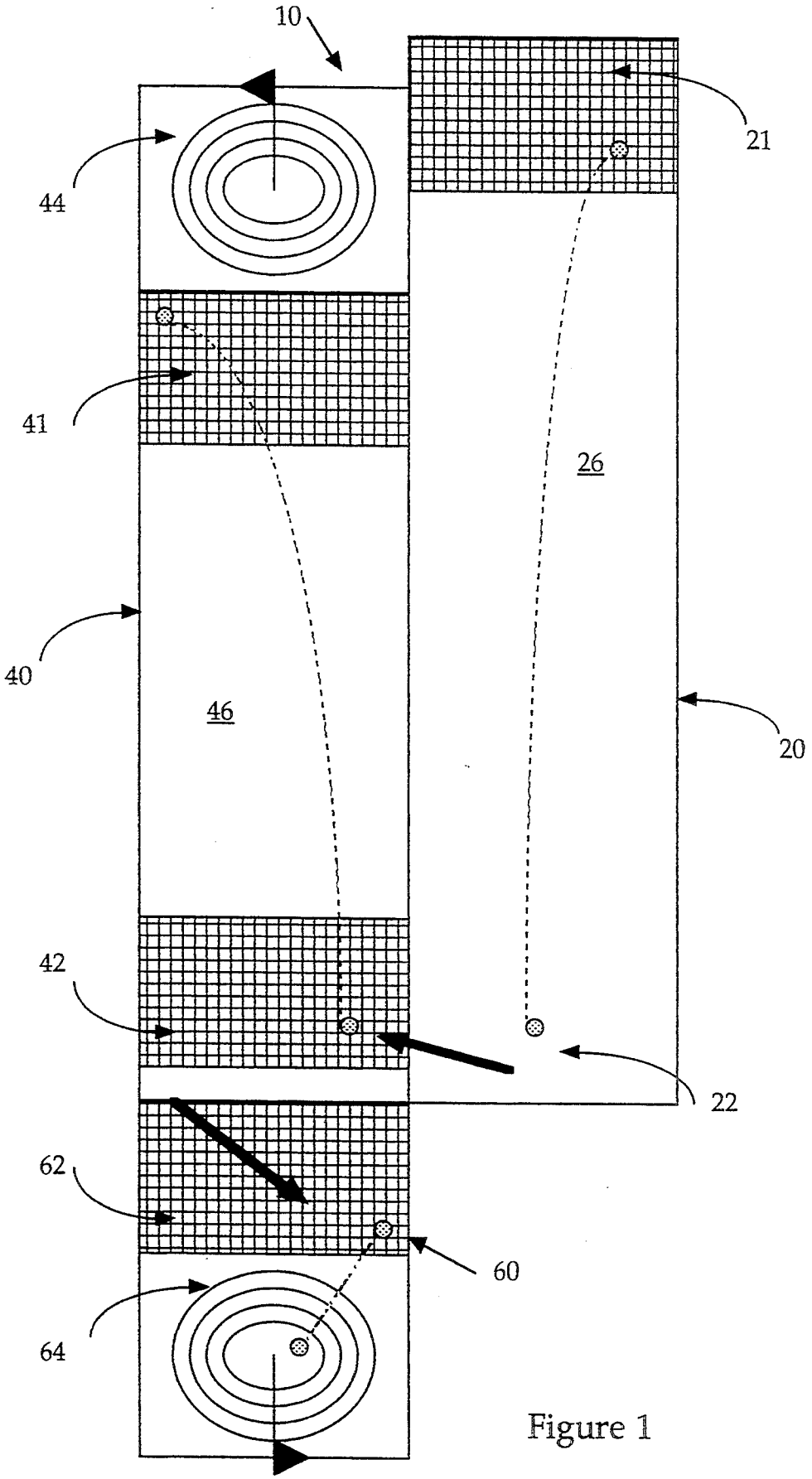
FIG. 1 represents a top view of a par 4 golf course hole in accordance with the teachings of this invention.

Referring now to the drawings and in particular FIG. 1, where the present invention is generally referred to with numeral 10, it can be observed that it basically includes tee shot area 20; approach shot area 40; and green shot area 60.

Figure 2:
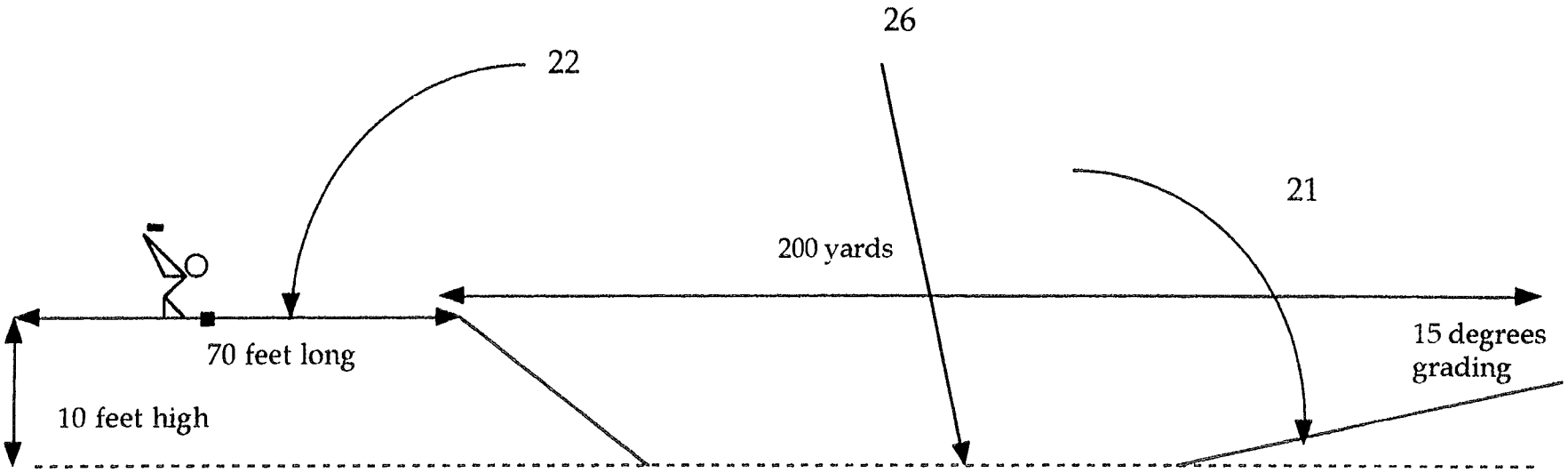
FIG. 2 shows a side elevational view of the tee shot area of the golf course hole represented in FIG. 1.

Tee shot area 20 is characterized by having an elevated teeing area 22 from where the hole shot starts and requiring the use of the clubs with the longest range. Tee shot area 20 extends longitudinally, in the preferred embodiment, approximately 250–300 yards with elongated fairway area 26 between teeing area 22 and first landing grid area 21. Tee shot area 20 does not include a green area since a player does not need one in his long shot. Rather, a player can determine the exact landing position of the ball in first landing grid area 21 with quadriculated markings which can then be transposed to second shot area 42. The grading of first grid area 21 is slight but sufficient to permit a player to see where the ball landed by identifying the specific quadriculated cell when the ball comes to rest. It has been found that 15° grading is adequate without materially altering the path of the ball. Grading of as low as 5° can also work in facilitating the determination of where a ball lands, without requiring the use of remote cameras or other optical aids. As it can be seen from FIG. 2, teeing area 22 is elevated, 10 feet in the preferred embodiment, over the closest portion of fairway area 26.

After hitting the first shot, a player moves laterally a relatively short distance to second shot area 42 from where he or she can hit a second ball that is dropped in a location that corresponds to where it landed in first grid area 21. Again, the location where the second ball comes to rest in second landing grid area 41 (also with quadriculated markings) or first green area 44 is transposed to third shot area 62. Second shot area 40, like first teeing area 20, includes second elongated fairway area 46 between second shot area 42 and second landing grid area 41.

Once it is determined where the second ball landed in second landing grid area 41, a player transposes it to third shot area 62 from where the short irons or putting irons are used to target second green area 64. The overall result of playing in this golf course is that, following the conventional rules of golf, players can maintain continuity from one shot to the next, with a minimum walking distance and without the danger of being hit by a ball from another player.

Figure 3:
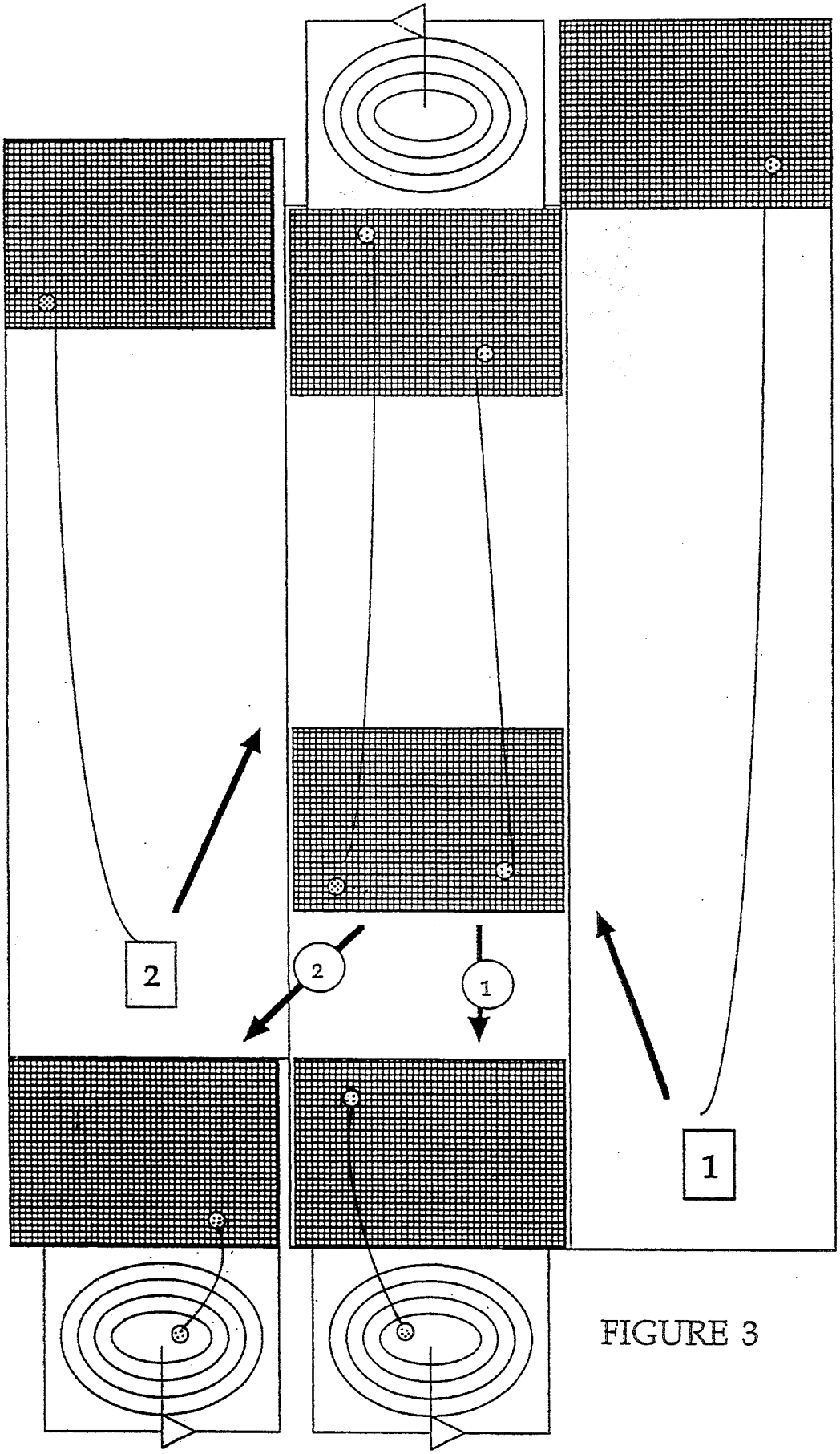
FIG. 3 illustrates a top view of a modified version of FIG. 1 incorporating the equivalent of two holes including two tee shot areas, one shared approach area, and two separate green areas.
Figure 4:
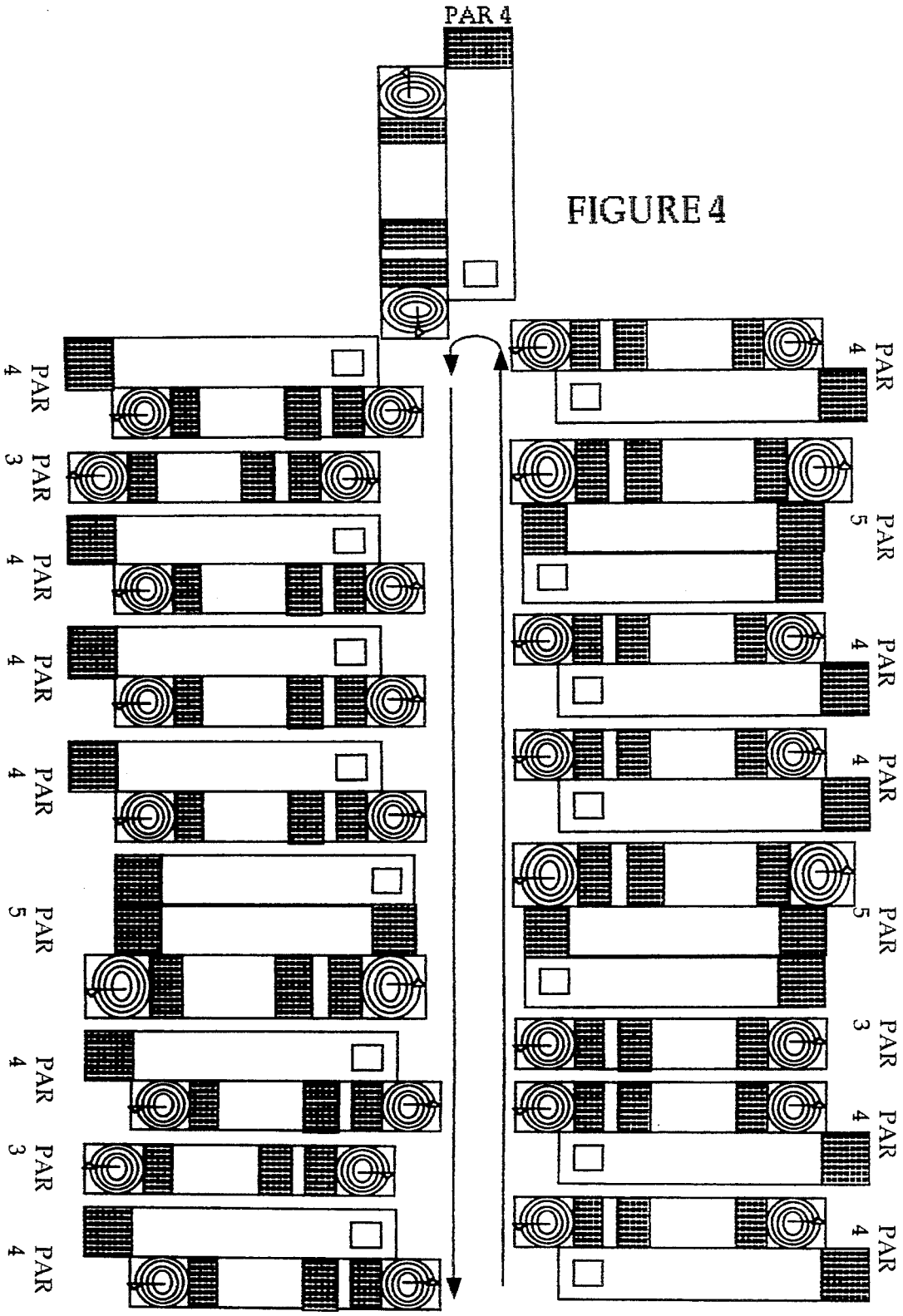
FIG. 4 is a representation of a golf course incorporating the teachings of the present invention wherein a holes of par 3; 4 and 5 are combined.

As can be seen in FIG. 3 the golf holes of the invention may be arranged in pairs wherein second and third shot areas are shared and sandwiched by first shot areas being adjacent to and in parallel relationship with respect to said second and third shot areas thereby minimizing the overall area required to implement the golf course.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A golf course hole for playing with a golf ball, comprising:

A. an elongated first shot area, having two ends, with a teeing area at one end and a first landing grid area at the other end, and said first shot area including a first elongated fairway area coaxially disposed between said teeing area and said first landing grid area, and said first landing grid area including quadriculated markings and a grading sufficient to permit a user to determine the landing location of said ball;

B. an elongated second shot area adjacent immediately to said first shot area and extending parallel thereto, and said elongated second shot area including first and second ends, a first green area at said first end, a second landing grid area adjacent immediately to said first green area and said second landing grid area including quadriculated markings, a second elongated fairway area adjacent immediately to said second landing grid area, an approach/putting shot area coaxially adjacent to said second elongated fairway area and defining said second end adjacent immediately to said teeing area and said approach shot area including quadriculated markings substantially identical to the quadriculated of said first landing grid area; and C. a third shot area coaxially disposed with respect to said second shot area and in abutting relationship thereto, and said third shot area being disposed in parallel and adjacent immediately relationship with respect to said elongated first shot area, and said third shot area including a green shot area having transposed quadriculated markings that correspond to the markings in said second landing grid area, a second green area adjacent to said approach/putting shot area so that the walking distance required for the players is minimized.

2. The golf course hole set forth in claim 1 wherein said teeing area is elevated with respect to said first fairway area a sufficient distance to permit a user to determine the landing location of said ball.

3. A golf course comprising a plurality of the golf course holes as set forth in claim 2 so that said golf course holes are contiguously arranged thereby minimizing the walking required of the player.

4. The golf course set forth in claim 3 wherein said plurality of golf course holes are arranged in pairs wherein the second and third shot areas are shared and sandwiched by said first shot areas being adjacent to and in parallel relationship with respect to said second and third shot areas thereby minimizing the overall area required to implement said golf course.

5. The golf course set forth in claim 4 wherein said grading has an angle between five and fifteen degrees.

* * * * *